United States Patent [19]

Yamamuro et al.

[11] Patent Number: 5,032,065

[45] Date of Patent: Jul. 16, 1991

[54] RADIAL PISTON PUMP

[75] Inventors: Sigeaki Yamamuro, Zushi; Nobuteru Hitomi, Yokohama, both of Japan

[73] Assignee: Nissan Motor Co., Ltd., Yokohama, Japan

[21] Appl. No.: 381,928

[22] Filed: Jul. 19, 1989

[30] Foreign Application Priority Data

| | | | |
|---|---|---|---|
| Jul. 21, 1988 | [JP] | Japan | 63-96614[U] |
| Aug. 16, 1988 | [JP] | Japan | 63-107804[U] |
| Oct. 31, 1988 | [JP] | Japan | 63-275879 |

[51] Int. Cl.[5] ..... F04B 23/04

[52] U.S. Cl. ..... 417/428; 417/429; 60/413

[58] Field of Search ..... 417/428, 429; 60/413, 60/486

[56] References Cited

U.S. PATENT DOCUMENTS

| | | | |
|---|---|---|---|
| 1,382,315 | 6/1921 | Philippi | 417/428 |
| 1,719,693 | 7/1929 | Ernst | 417/429 |
| 1,781,416 | 11/1930 | Sundstrand | 417/429 |
| 2,968,915 | 1/1961 | Fiestel, Jr. | 417/428 |
| 4,502,845 | 3/1985 | Chana | 417/428 |

*Primary Examiner*—A. Michael Chambers

*Attorney, Agent, or Firm*—Pennie & Edmonds

[57] ABSTRACT

A variable displacement radial piston pump includes a plurality of pump sections which are grouped into two. A first group of pump sections are communicable through a first discharge passage with a third discharge passage. A second group of pump sections are communicable through a second discharge passage with the third discharge passage. A control valve is provided for selectively supplying discharge from said first and second groups of pump sections to the third discharge passage and thereby stepwisely varying the discharge through the third discharge passage.

25 Claims, 11 Drawing Sheets

RADIAL PISTON PUMP

BACKGROUND OF THE INVENTION

1. Field of the Invention

The present invention relates to a radial piston pump, particularly of the type suited for use in an active suspension system.

2. Description of the Prior Art

A prior art variable displacement radial piston pump includes a rotatable cylinder block, a plurality of pistons reciprocally installed in the cylinder block and arranged in a circular array, and an eccentric cam in contact with the outer ends of the pistons so that rotation of the cylinder block causes reciprocation of the pistons. By the reciprocation of the pistons, fluid is drawn into the pump and then discharged from same.

The prior art variable displacement radial piston pump is of the so-called rotary cylinder type and adapted so that the displacement can be varied by moving a casing and thereby varying the eccentricity of the cam.

The prior art variable displacement radial piston pump has a problem that it is large in size, heavy and requires a large operating force for variation of the displacement so that it is not suited for use in an automotive vehicle.

Another problem is that errosion is liable to occur in the pump to shorten its life.

SUMMARY OF THE INVENTION

In accordance with the present invention, there is provided a novel variable displacement radial pistion pump which comprises a drive shaft, an eccentric cam means eccentric with the drive shaft and rotatable with same, a casing formed with a plurality of cylinders arranged around the drive shaft and radially of same, a plurality of pistons installed in the cylinders and having inner ends in contact with the eccentric cam means, respectively, the cylinders and the pistons cooperating with each other to define a plurality of pump sections which are grouped into two, suction passage means for conducting fluid into the pump sections as the pistons reciprocate being driven by the eccentric cam means, first discharge passage means communicating with a first group of pump sections for conducting discharge from the first group of pump sections as the pistons reciprocate being driven by the eccentric cam means, second discharge passage means communicating with a second group of pump sections for conducting discharge from the second group of pump sections as the pistons reciprocate being driven by the eccentric cam means, third discharge passage means communicable with the first and second discharge passage means for collecting discharge therefrom, control valve means for selectively supplying discharge from the first and second discharge passage means to the third passage means and thereby stepwisely varying discharge through the third discharge passage means.

The above structure is effective for solving the above noted problems inherent in the prior art radial piston pump.

It is accordingly an object of the present invention to provide a novel variable displacement radial piston pump which can be compact, light in weight and requires only a small operating force for change of displacement.

It is another object of the present invention to provide a novel variable displacement radial piston pump of the above described character which is suited for use in automotive vehicles.

It is a further object of the present invention to provide a novel variable displacement radial piston pump of the above described character which is quiet in operation and can effect an extended life.

It is a yet further object of the present invention to provide a radial piston pump which can prevent errosion.

It is a still further object of the present invention to provide a radial piston pump which can effect an extended life.

DESCRIPTION OF THE PREFERRED EMBODIMENTS

Figure 3:
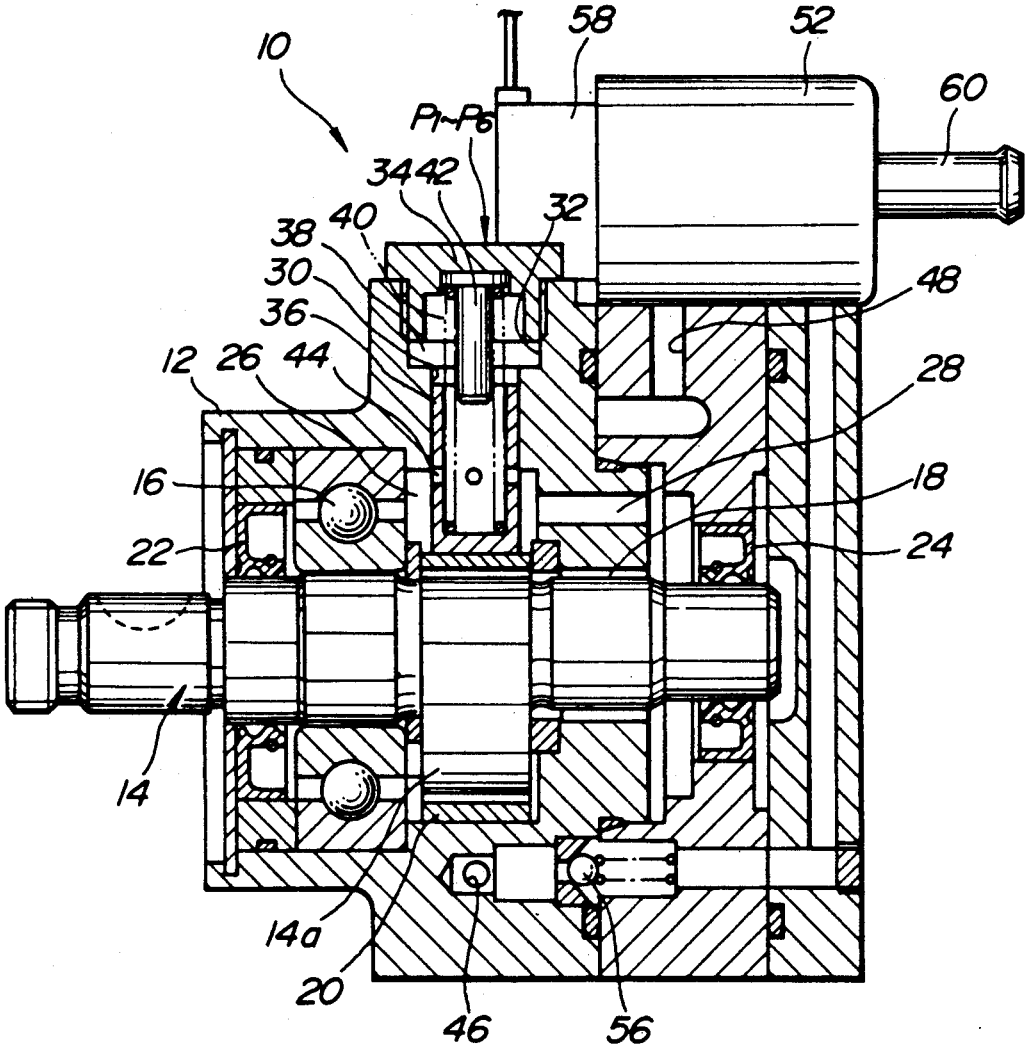
FIG. 3 is a detailed sectinal view of the radial piston pump of FIG. 1.

Referring first to FIG. 3, a variable displacement radial piston pump 10 includes a casing 12 in which a drive shaft 14 is rotatably installed by means of bearings 16, 18. The drive shaft 14 has, between the portions supported by the bearings 16, 18, an eccentric shaft portion 14*a* on which an eccentric cam 20 is installed. The eccentric cam 20 is received in a cavity of the casing 12 which is sealingly closed by oil seals 22, 24. The cavity includes a suction chamber 26 communicating a suction passage 28. Six cylinders 30 are formed in the casing 12 in such a way as to extend radially of the drive shaft 12 and be arranged in a circular array with equal intervals. That is, the cylinders 30 are located next to or adjacent to the suction chambers 26 and extend therefrom radially outward of the drive shaft 12. Plug holes 32 concentric with the cylinders 30 are provided next to the outer ends of the cylinder 30. Plugs 34 are screwed into the plug holes 32 to sealingly close the outer ends of the plug holes 32.

Hollow pistons 36 are movable in each cylinders 30 and each have a closed inner end and an opened outer end. Cylinder chambers 38 are defined by the inner walls of the pistons 36, the inner walls of the plugs 34, the cylinders 30 and the plug holes 32. The pistons 36 are urged, by means of springs 40 which are interposed between the pistons 36 and spring retainers 42 fitted in the plugs 34, to project into the suction chambers 26 and contact at the inner ends with the eccentric cam 20. The pistons 36 are formed at the circumferential walls with suction ports 44 for providing communication between the suction chamber 26 and the cylinder chambers 38. The suction ports 44 are arranged so as to be covered and uncovered, i.e., closed and opened by the cylinders 30 as the pistons 36 reciprocate and thereby provide and obstruct communication between the suction chamber 26 and the cylinder chambers 38.

The casing 12 is formed with discharge ports 46 communicating with the respective cylinder chambers 38. The discharge ports 46 are grouped into two so that a first group of discharge ports 46 communicate a larger displacement discharge passage 48 and a second group of discharge ports 46 communicate a smaller displacement discharge passage 50. The discharge passages 48, 50 are connected to a three position directional control valve (discharge control valve) 52. Check valves 54, 56 are disposed in the discharge passages 48, 50, respectively (the check valve 54 is shown in FIG. 3). The three position directional control valve 52 is driven by an actuator 58 which may be a solenoid, stepping motor, or the like. A discharge passage 60 is connected to the control vale 52.

Figure 1:
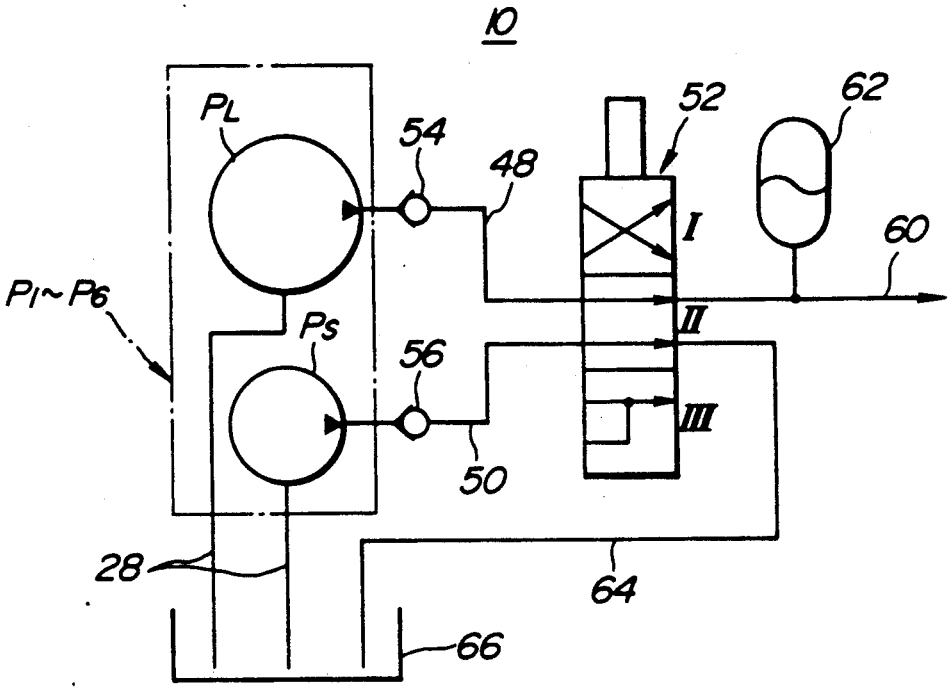
FIG. 1 is a schematic view of a variable displacement radial piston pump according to an embodiment of the present invention.
Figure 4:
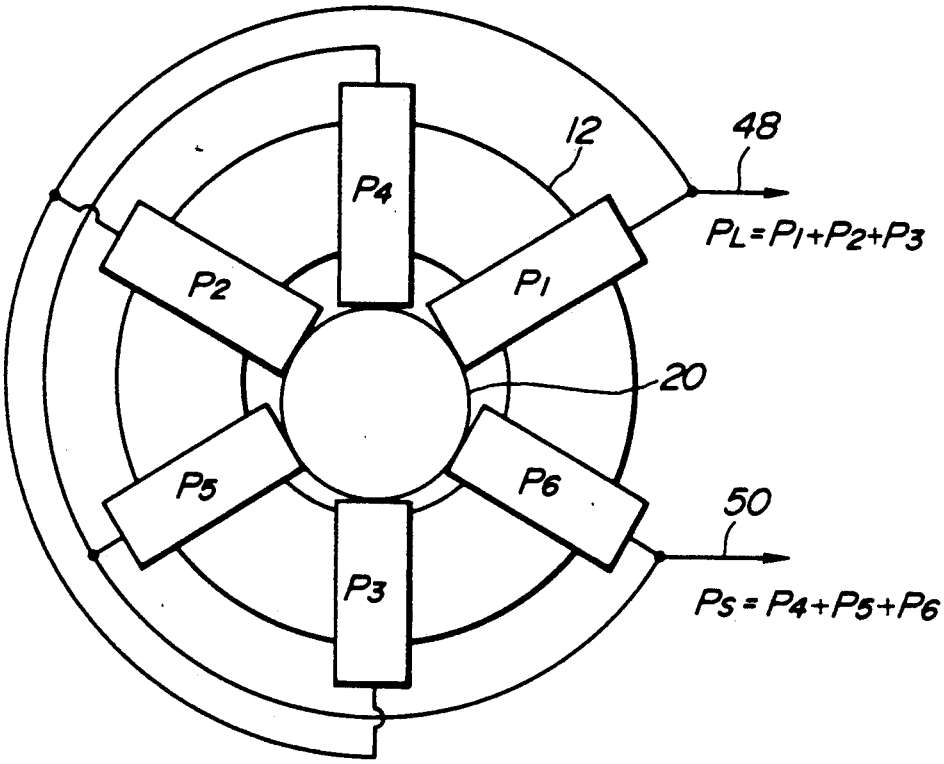
FIG. 4 is a schematic view of pump sections grouped into two of the same number for making the displacement variable.

The variable displacement radial piston pump 10 described above is therefore of the fixed cylinder type and schematically shown in FIG. 1. Referring to FIG. 1, the fixed cylinder type radial piston pump 10 includes a larger displacement pump part PL and a smaller displacement pump part PS. The larger displacement pump part PL is communicated with the larger displacement discharge passage 48 while the smaller displacement pump part PL is communicated with the smaller displacement discharge passage 50. In this connection, as shown in FIG. 4, the radial piston pump 10 includes six pump sections P1–P6 arranged in a single circular array. The pump sections P1–P6 are grouped into two so that a first group of pump sections P1–P3 constitute the larger displacement pump part PL and a second group of pump sections P4–P6 constitute the smaller displacement pump part PS.

Figure 5:
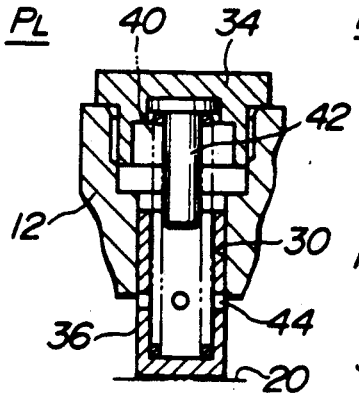
FIGS. 5 and 6 are sectional views of pump sections having pistons of different diameters for making the displacement variable.
Figure 6:
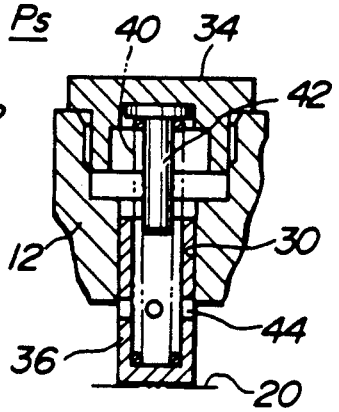
Figure 7:
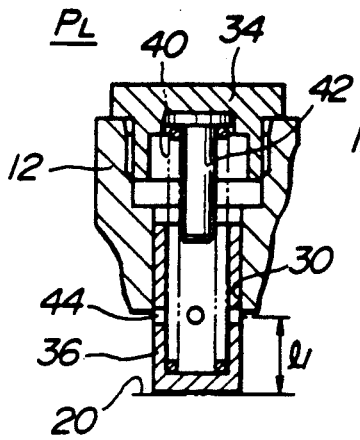
FIGS. 7 and 8 are sectional views of pump sections having suction holes of different arrangements for making the displacement variable according to a modification of the present invention.
Figure 8:
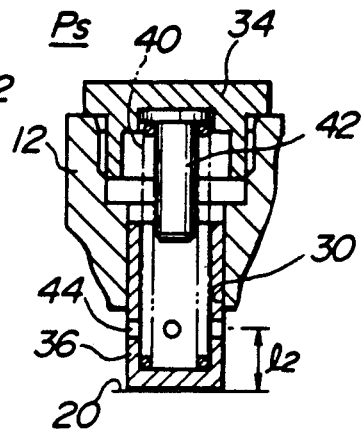

The pistons 36 of the first group of pump sections P4–P6 as shown in FIGS. 5 and 6 so that the first group of pump sections can attain a larger displacement than the second group of pump sections. To the same end, the pistons 36 for the first and second groups of pump sections may have the same diameter and be different in the arrangement of the suction port 44 in such a manner that the distance $l_1$ between the suction port 44 and the inner end of the piston 38 of the larger displacement pump section is larger than the corresponding distance $l_2$ of the smaller displacement pump section (i.e., $l_1 > l_2$).

The discharge passages 48, 50 are selectively communicated with the collective discharge passage 60 under control of the three position directional control valve 52. An accumulator 62 is comunicated with the discharge passage 60. A drain passage 64 is provided for providing communication between the control valve 52 and a reservoir 66. The suction passage 28 is communicated with the reservoir 66.

The operation of the variable displacement radial piston pump 10 will now be described.

The eccentric cam 20 is driven by the drive shaft 14 to rotate. Rotation of the eccentric cam 20 causes the pistons 36 to reciprocate radially of the drive shaft 14. During the reciprocation, the pump sections P1–P6 effect a suction stroke in which the piston 36 is driven toward the eccentric cam 20 with the cylinder chamber 38 being communicated with the suction chamber 26 through the suction port 44 so that fluid is drawn through the suction port 44 into the cylinder chamber 38 and a discharge stroke in which the piston 36 is driven away from the eccentric cam 20 with the suction port 44 being closed by the cylinder 36 so that fluid is discharged from the cylinder chamber 38 into the discharge port 46.

Variation of discharge for a griven pump r.p.m. is attained by varying the position I, II or III of the directional control valve 52 which is controlled in response to a command signal.

Figure 2:
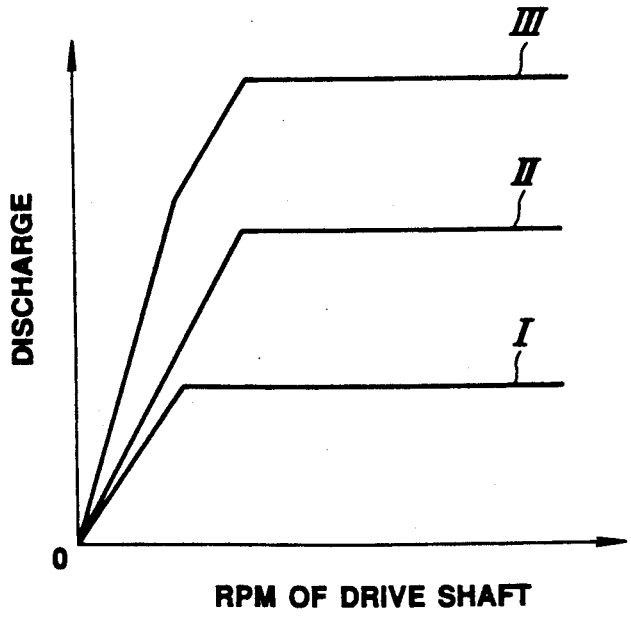
FIG. 2 is a graph of discharge on r.p.m. of the radial piston pump of FIG. 1.

That is, when the three position directional control valve 52 is put into the position I, only the smaller displacement pump part PS is communicated with the discharge passage 60 to provide a smaller discharge thereto and therefore effects such a discharge characteristic "I" shown in FIG. 2. When the control valve 52 is put into the position "II", the larger dispacement pump part PL is communicated with the discharge passage 60 to provide a larger discharge thereto and therefore effects such a discharge characteristic "II" shown in FIG. 2. When the control valve 52 is put into the position "III", both of the pump parts PL and PS are communicated with the discharge passage 60 to provide both the smaller and larger discharges thereto and therefore effects such a discharge characteristic "III" shown in FIG. 2.

Accordingly, though the above radial piston pump 10 is of the fixed cylinder type, its displacement can be stepwisely varied in three ways. The radial piston pump 10 is compact, light in weight and can be operated for variation of displacement with a small operating force.

The larger displacement pump section PL and the smaller displacement pump section PS in the six-cylinder pump can be attained in various ways as follows.

Figure 9:
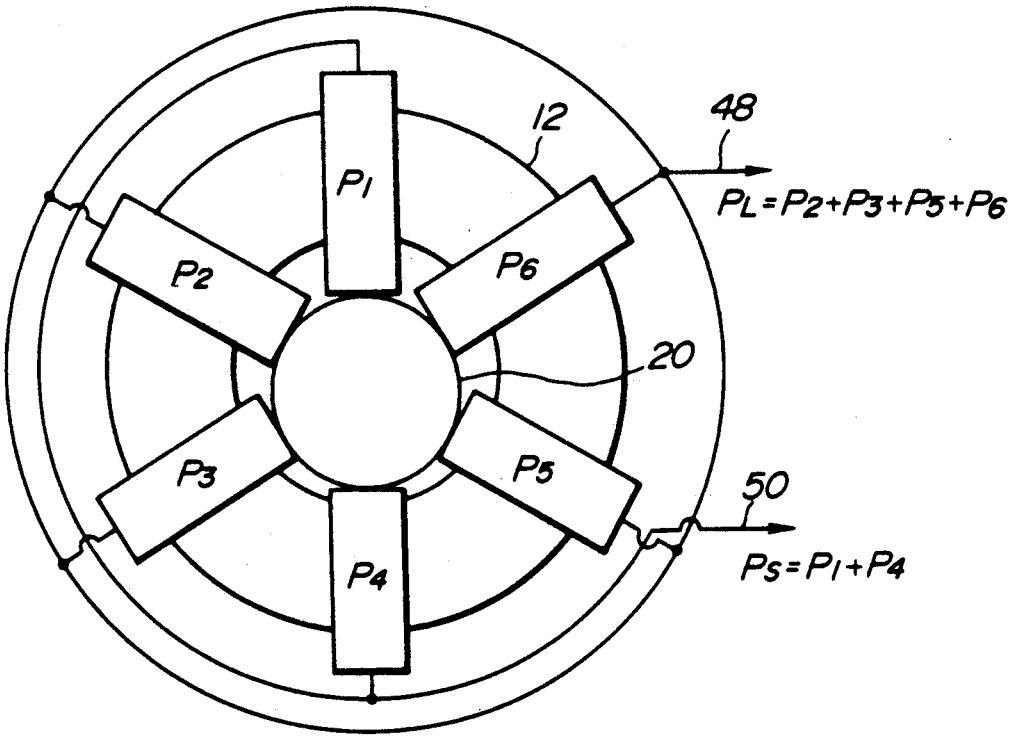
FIG. 9 is a schematic view of pump sections grouped into two of different numbers for making the displacement variable according to another modification of the present invention.

FIG. 9 shows a modification of this invention. According to this modification, the six pump sections P1–P6 arranged in a single circular array have the same displacement and is grouped into two in such a manner that a first group includes four pump sections P2, P3, P5, P6 to constitute the larger displacement pump part PL and a second group includes two pump sections P1, P4 to constitute the smaller displacement pump part PS.

Figure 10:
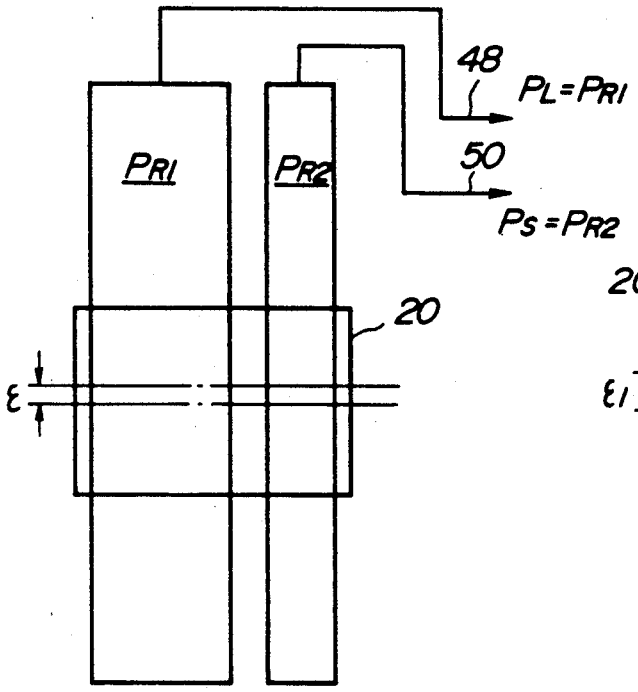
FIGS. 10 to 13 are schematic views of various arrangements of pump sections in two circular arrays according to further modifications of the present invention.

FIG. 10 shows another modification. According to this modification, the twelve pump sections are arranged in two arrays PR1, PR2 (i.e., each row includes six pump sections arranged in the above described manner) and adapted to be driven by the common eccentric cam, i.e., by the cam of the same eccentricity $\epsilon$. The six pump sections in one array are adapted to constitute the larger displacement pump part PL and the six pump sections in another array are adapted to constitute the smaller displacement pump part PS. The difference in displacement pump part PS. The difference in displacement between the pump parts PL, PS is attained in the manner described with reference to FIGS. 5–8. With this arrangement of the pump sections, the pump can be small-sized in the radial direction of the drive shaft 14 and at the same time the increased number of pump sections can reduce the surface pressure of the eccentric cam 20 and the pistons 36, thus making it possible to increase the life.

Figure 11:
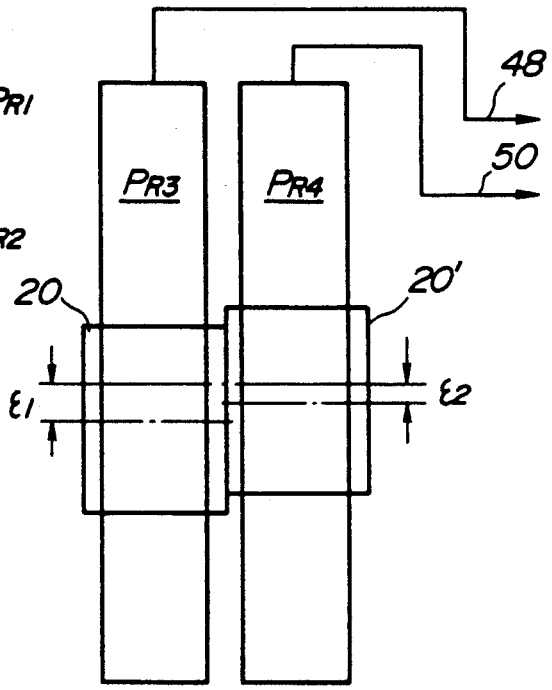

FIG. 11 shows a further modification. The twelve pump sections are arranged in two circular arrays PR3, PR4 and adapted to be driven by the eccentric cams 20, 20' of the different eccentricities $\epsilon_1$, $\epsilon_2$ so that the pump sections in one array are driven by the eccentric cam 20 of the larger eccentricity $\epsilon_1$ for thereby constituting the larger displacement pump part PL and the pump sections in another array are driven by the eccentric cam 20' of the smaller eccentricity $\epsilon_2$ for thereby constituting the smaller displacement pump part PS. With this modification, all the pistons of the pump sections can be the same in the diameter and all the suction ports 44 can be the same in arrangement relative to the inner ends of the pistons 38. Further, when the eccentric cams 20, 20' are arranged so as to differ 180° in phase from each other, the loads applied from the pistons 38 to the eccentric cams 20, 20' offset each other, thus making it possible to reduce the vibrations.

Figure 12:
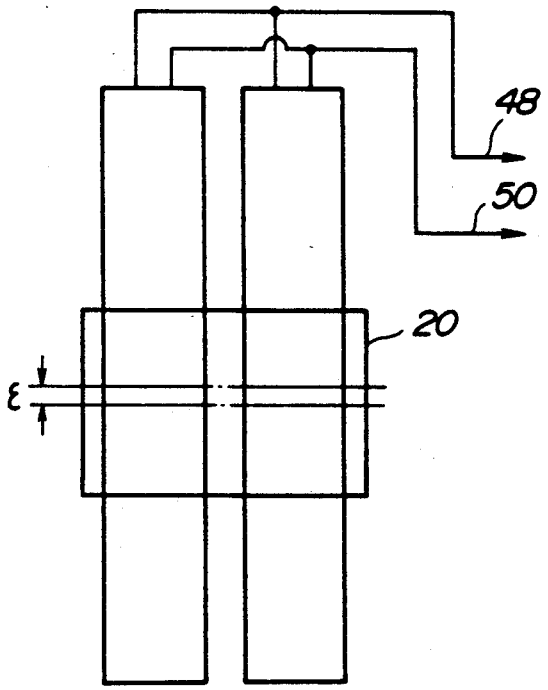

FIG. 12 shows a further modification. According to this modification, the twelve pump sections are arranged in two circular arrays and adapted to be driven by the cam 20 of the same eccentricity $\epsilon$. The larger displacement pump part PL is constituted by more than seven pump sections and the smaller displacement pump part PS is constituted by less than five pump sections. With this arrangement, when the pump sections are grouped into two so that a first group includes seven and a second group includes five or a first group includes nine and a second group includes three, the pulsation and vibration can be reduced as compared with the case in which the pump sections are grouped so that each groups include even numbers.

Figure 13:
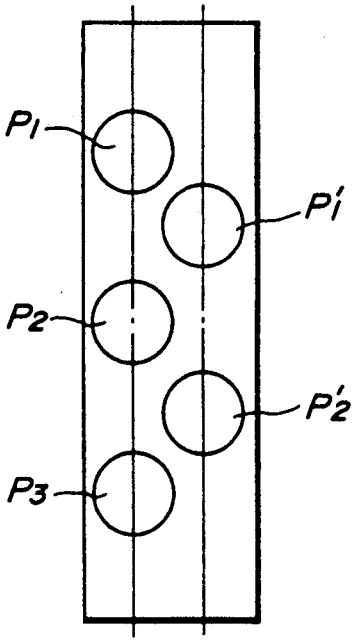

FIG. 13 shows a further modification. According to this modification, the pump sections are arranged in two circular arrays and in such a way as to overlap each other in the axial direction of the drive shaft 14. That is, the pump sections in two circular arrays are arranged in such a way that one pump section P1' or P2' of one circular arrany is located equidistant from adjacent two pump sections P1, P2 or P2, P3 of another circular array when observed in a plane of projection perpendicular to the axis of the drive shaft 14. With this arrangement, the radial piston pump 10 can be reduced in size in the axial direction of the drive shaft 14.

Figure 14:
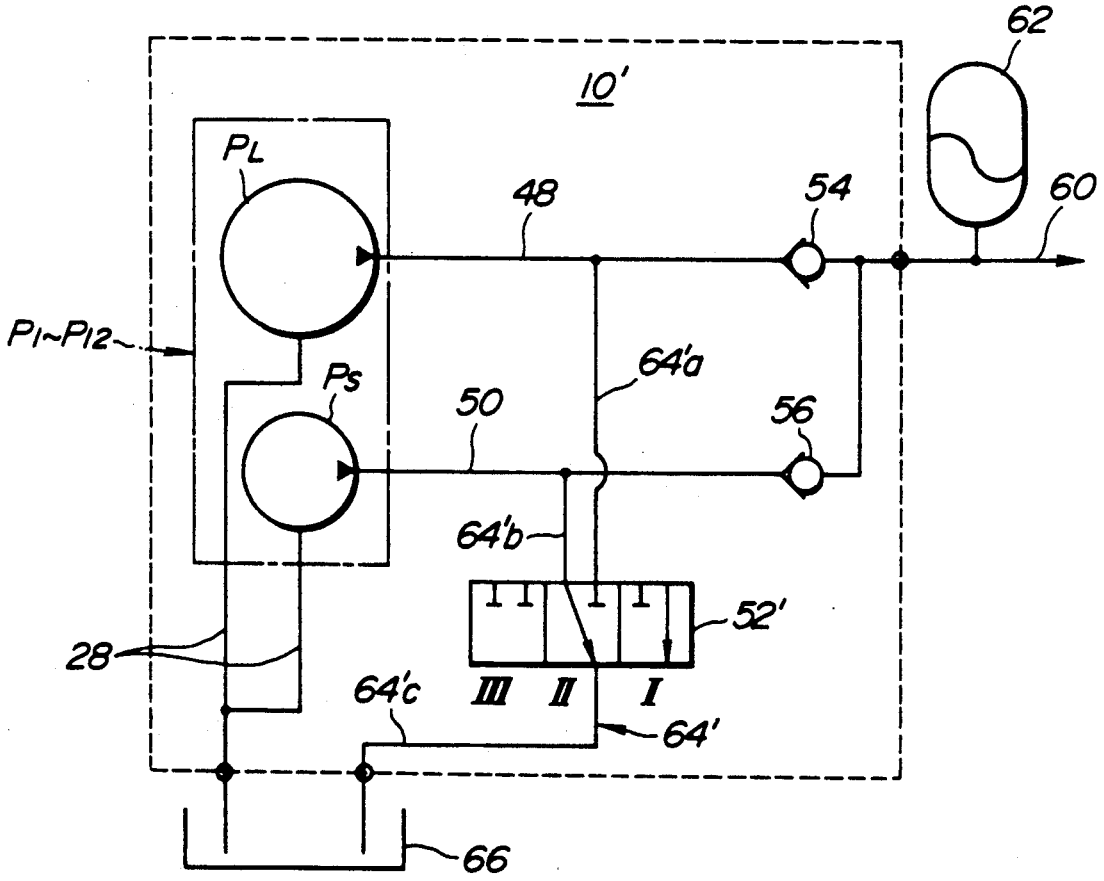
FIG. 14 is a view similar to FIG. 1 but shows a variable displacement radial piston pump according to another embodiment of this invention.
Figure 15:
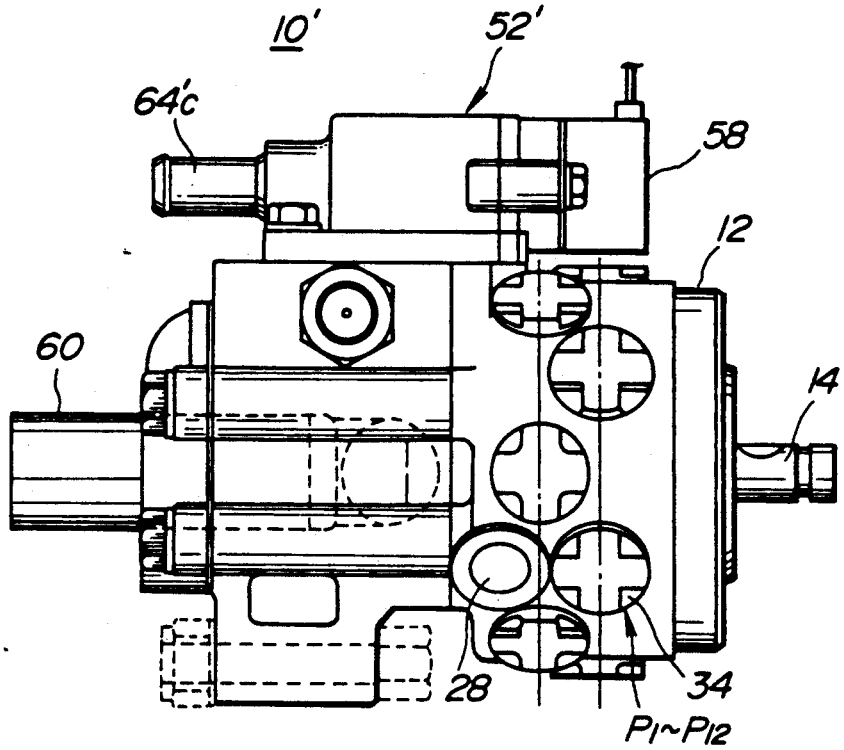
FIG. 15 is a side elevational view of the radial piston pump of FIG. 14.
Figure 16:
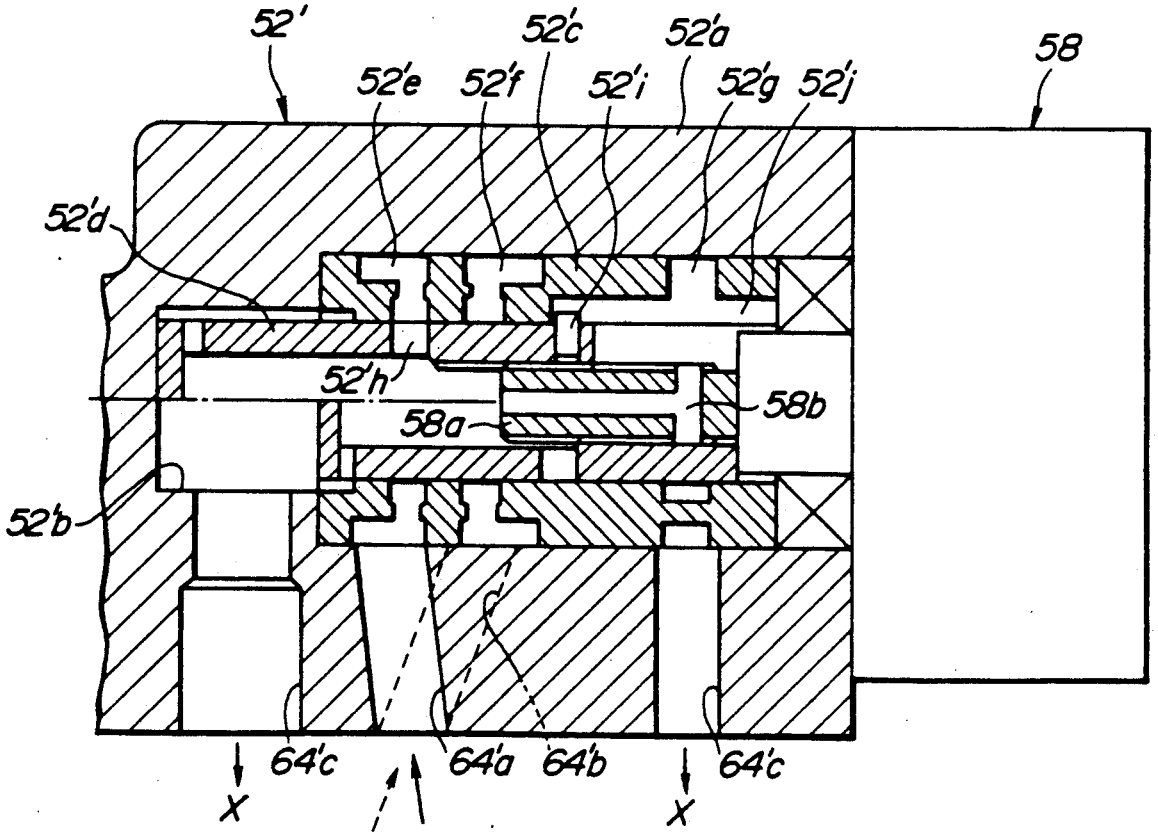
FIG. 16 is a sectional view of a three position directional control valve employed in the radial piston pump of FIG. 14.

Referring to FIGS. 14 to 16, in which parts and portions like or corresponding to those of the previous embodiment are designated by the same reference characters, the variable displacement radial piston pump 10' includes pump sections which are arranged in the manner described with reference to FIG. 13, i.e., arranged in two circular arrays and in a zigzag manner as seen from FIG. 15.

The three position directional control valve 52' is adapted to be actuated by a stepping motor 58 and secured to the casing 12. The larger displacement discharge passage 48 and smaller displacement discharge passage 50 are directly connected to the discharge passage 60. The three position directional control valve 52' is disposed in the drain passage 64' for controlling the displacement of the pump 10'. The drain passage 64' consists of a pair of first and second upstream drain passage sections 64'*a*, 64'*b* and a downstream drain passage sections 64'*c*. The first upstream drain passage section 64'*a* is connected at an upstream end to a passage portion of the larger displacement discharge passage 48 upstream of the check valve 54 and at the downstream end to the control valve 52'. The second upstream drain passage section 64'*b* is connected at the upstream end to a passage portion of the smaller displacement discharge passage 50 upstream of the check valve 56 and at the downstream end to the control valve 52'. The downstream drain passage section 64'*c* is connected at the upstream end to the control valve 52' and communicated at the downstream end with the reservoir 66.

The detail of the directional control valve 52' is shown in FIG. 16. The control valve 52' is adapted to be driven by the stepping motor 58' and includes a valve casing 52'*a* formed with a valve hole 52'*b*, a fixed guide sleeve 52'*c* installed in the valve hole 52'*b* and a hollow plunger 52'*d* movably installed in the fixed guide sleeve 52'*c* and threadedly engaged with a threaded drive shaft 58*a* of the stepping motor 58. The guide sleeve 52'*c* is formed with a larger displacement drain port 52'*e* communicated through the upstream drain passage section 64'*a* with the larger displacement discharge passage 48, a smaller displacement drain port 52'*f* communicated through the upstream drain passage section 64'*b* with the smaller displacement discharge port 50 and an outlet port 52'*g* communicated through the downstream drain passage section 64'*c* with the reservoir 66. The plunger 52'*d* is formed with a communication control port 52'*h* which is selectively communicable with the drain ports 52'*e*, 52'*f* for thereby communicating therethrough the drain ports 52'*e*, 52'*f* with the outlet port 52'*g*. A guide pin 52'*i* is fixed to the plunger 52'*d* and slidably received in a groove 52'*j* formed in the guide sleeve 52'*c* so that the plunger 52'*d* is prevented from rotation relative to the guide sleeve 52'*c* and thereby axially movable relative to the drive shaft 58*a* of the stepping motor 58 upon rotation of same. The drive shaft 58*a* of the stepping motor 58 is formed with a drain passage 58*b* for providing communication between the communication control port 52'*h* and the outlet port 52'*j* through the inside of the plunger 52'*d*.

The operation of the above modified embodiment will be described.

When the control valve 52' is in the first position "I", the plunger **52'*d* assumes the position shown by the upper half of the plunger in FIG. 16. The communication control port 52'*h* is thus communicated with the larger displacement drain port 52'*e* and provides communication between the port 52'*e* and the outlet port 52'*g*. The drain passage section 64'*a* is thus communicated with the drain passage section 64'*c*, thus allowing all the discharge from the larger displacement pump part PL to be drained to the reservoir 66. On the other hand, the smaller displacement drain port 52'*f* is closed by the outer periphery of the plunger 52'*d* and thereby prevented from communication with the outlet port 52'*g*. The discharge from the smaller displacement pump part PS is thus supplied through the smaller displacement discharge passage 50 and check valve 56 to the discharge passage 60**.

Accordingly, when the control valve 52' is in the position "I", only the smaller displacement pump part PS becomes effective, whereby to attain the discharge characteristic "I" shown in FIG. 2.

In the meantime, the discharge of the pump becomes constant at the higher r.p.m. as shown in FIG. 2. This is because the suction of the pump cannot increase in proportion to increase of r.p.m. at the higher r.p.m. operating range of the pump.

When the control valve 52' is put into the position "II", the communication control port **52'*h* is communicated with the smaller displacement drain port 52*f* and therefore provides communication between the port 52'*f* and the outlet port 52'*g*. The drain passage section 64'*b* is thus communicated with the drain passage section 64'*c*, thus allowing all the discharge of the smaller displacement pump part PS to be drained to the reservoir 66. On the other hand, the larger displacement drain port 52'*e* is closed by the periphery of the plunger 52'*g* and therefore prevented from communication with the outlet port 52'*g*, thus allowing the discharge from the larger displacement pump part PL to be supplied through the larger displacement discharge passage 48 and check valve 54 to the discharge passage 60. Accordingly, when the control valve 52' is in the position "II", only the larger displacement pump part PL becomes effective, whereby to effect the discharge characteristic "II" shown in FIG. 2**.

When the control valve 52' is put into the position "III", both the ports **52'*e*, 52'*f* are covered by the periphery of the plunger 52'*d* as shown by the lower half section of the plunger in FIG. 16, thus prevented from communication with the outlet port 52'*g*. Thus, the discharges from both the larger displacement pump part PL and smaller displacement pump part PS are supplied to the discharge passage 60. When the control valve 52' is in the position "III", both the larger displacement pump part PL and smaller displacement pump part PS become effective, whereby to effect the discharge characteristic "III" shown in FIG. 2**.

During change of mode or position of the control valve 52', the radial piston pump 10' operates as follows. Now, it is assumed that during change of mode of the control valve 52' from the position "I" to the position "II" the larger displacement drain port **52'*e* is closed by the periphery of the plunger 52'*d* before the smaller displacement drain port 52'*f* is comminicated with the communication control port 52'*h*. In this instance, the discharge from the larger displacement pump part PL is supplied through the check valve 54 to the discharge passage 60. Thus, the pressure in the larger displacement discharge passage 48 is not caused to rise beyond a predetermined value which is determined by the check valve 54, i.e., the above difference in the opening and closing timing between the larger displacement drain port 52'*e* and the smaller displacement drain port 52'*f* does not cause the discharge from the larger displacement pump part PL to be confined in the larger displacement discharge passage 48 and therefore does not cause an extreme or dangerous rise of the pressure in the larger displacement discharge passage 48**.

It is then assumed that during the change of the mode of the control valve 52' from the position "I" to the position "II" the closing timing of the larger displacement drain port **52'*e* and the opening timing of the smaller displacement drain port 52'*f* overlap, i.e., the smaller displacement drain port 52'*f* starts opening before the larger displacement drain port 52'*e* is completely closed so that the discharge from both of the pump parts PL, PS are all drained. In this instance, since the drain passage sections 64'*a*, 64'*b* are arranged so as to branch off from the portions of the discharge passages 48, 50 upstream of the check valves 54, 56, the fluid pressures in the portions of the discharge passages 48, 50 upstream of the check valves 54, 56 are temporarily lowered and allow the check valves 54, 56 to close due to the difference in pressure between the upstream side and downstream side of the check valves 54, 56. Accordingly, the fluid pressure in the discharge passage 60** is assuredly prevented from becoming so low as to deteriorate the operating efficiency of an associated actuator.

Figure 17:
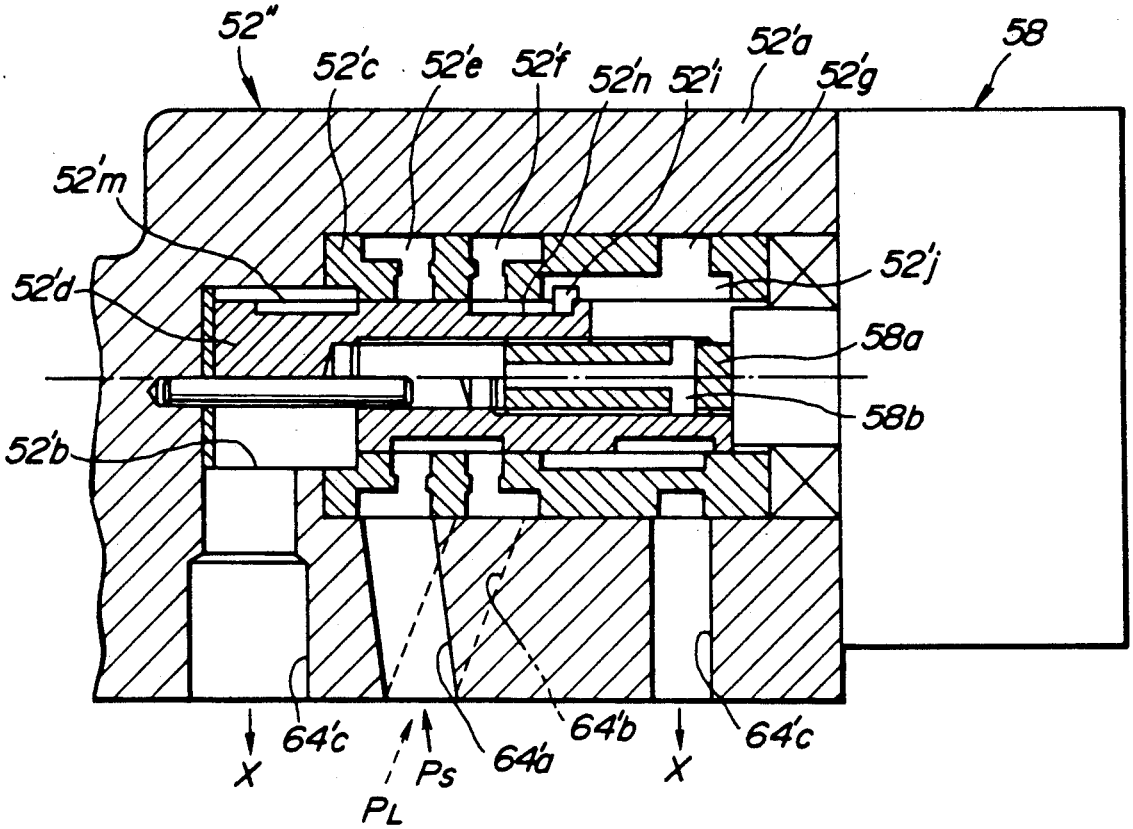
FIG. 17 is a view similar to FIG. 16 but shows a modification of the present invention.

In place of the control valve 52', a three position directional control valve 52'' shown in FIG. 17 may be used. The control valve 52'' mainly differs from the control valve 52' in that the plunger **52''*d* is formed with two peripheral grooves 52'*m*, 52'*n* which are constructed and arranged so that only the groove 52'*m* provides communication through the pierphery of the plunger 52'*d*, i.e., through the groove 52'*m* between the larger displacement drain port 52'*e* and the downstream drain passage section 64'*c* when the control valve 52'' is in the first position "I", only the groove 52'*n* provides communication with the smaller displacement port 52'*f* and the outlet port 52'*g* through the guide groove 52'*j* when the control valve 52'' is in the second position "II" and the groove 52'*m* is alinged with both the larger displacement drain port 52'*e* and smaller displacement drain port 52'*f* to close the same when the control valve 52'' is in the position "III". Except for the above, the control valve 52'' is substantially similar to the control valve 52'** and can produce the same effect.

Figure 18:
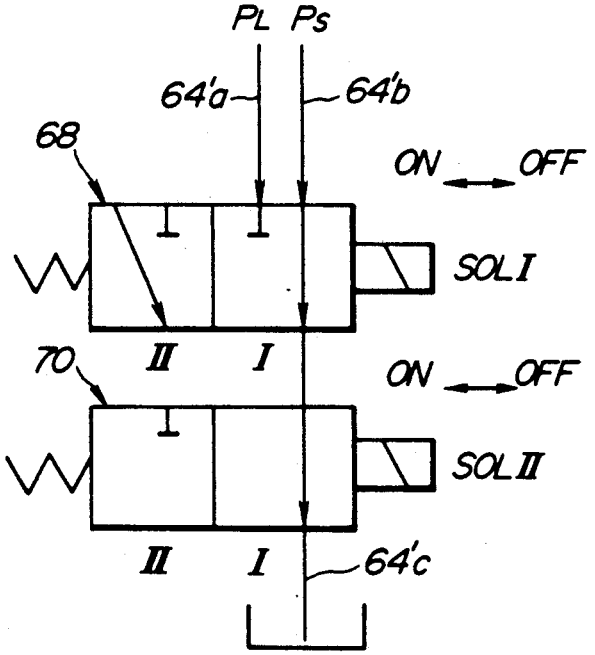
FIG. 18 is a schematic view of a pair of two position directional control valves employed in the radial piston pump of FIG. 14 in place of the three position directional control valve according to a modification of the present invention.

As shown in FIG. 18, in place of the above control valve 52' or 52'', a pair of two position solenoid valves 68, 70 can be employed. The solenoid valves 68, 70 respectively operated by solenoids "I", "II" are arranged in series in the drain passage 64 in such a manner that when the solenoid valves 68, 70 are in the positions "I" the larger displacement drain passage 48 is drained to the reservoir 66 through the drain passage section **64'*b* and the drain passage section 64'*c*, that when the solenoid valve 68 is in the position "II" and the solenoid valve 70 is in the position "I" the smaller displacement discharge passage 50 is drained to the reservoir 66 through the drain passage section 64'*b* and drain passage section 64'*c* and that when the solenoid valve 68 is in the position "I" and the solenoid valve 70 is in the position "II" both the larger displacement drain passage 48 and smaller displacement drain passage 50 are prevented from being drained to the reservoir 66. The two position solenoid valves 68, 70 thus can produce the same effect as the three position directional control valve 52' or 52"**.

From the foregoing, it will be understood that an abnormal or dangerous rise or fall of the fluid pressure is assuredly prevented from being caused in the discharge passages, thus making it possible to increase the life and improve the accuracy in suspension height control by an active suspension system.

Figure 19:
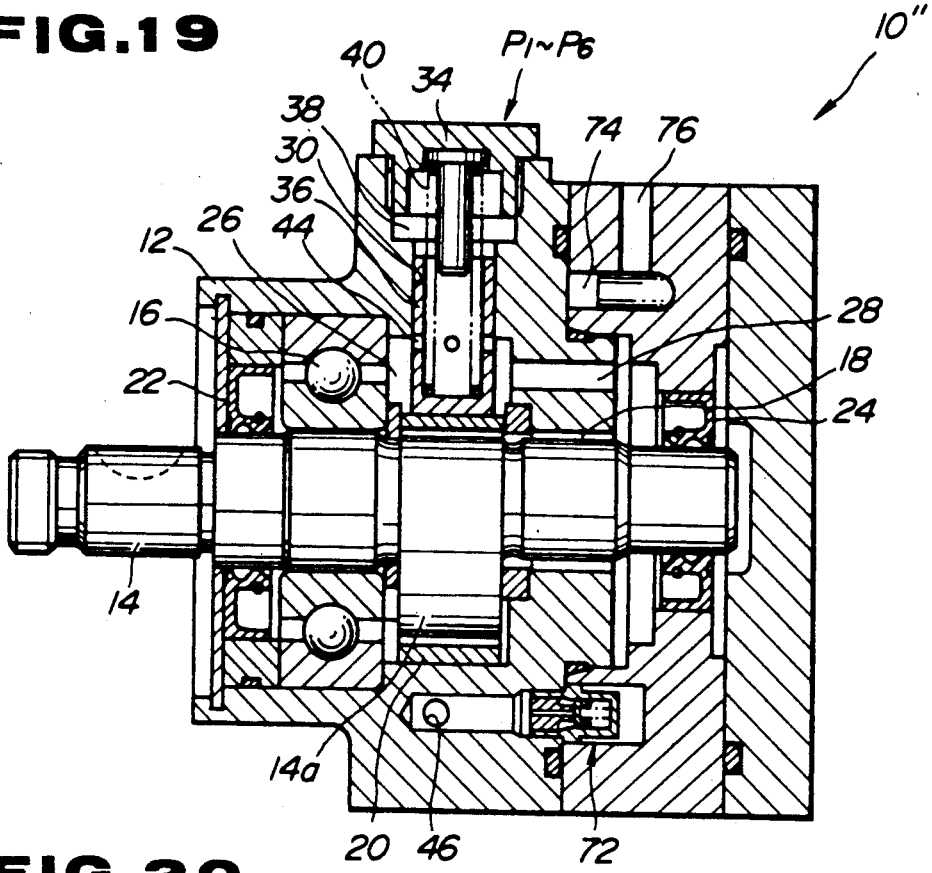
FIG. 19 is a sectional view similar to FIG. 3 but shows a fixed displacement radial piston pump according to a further embodiment of the present invention.
Figure 20:
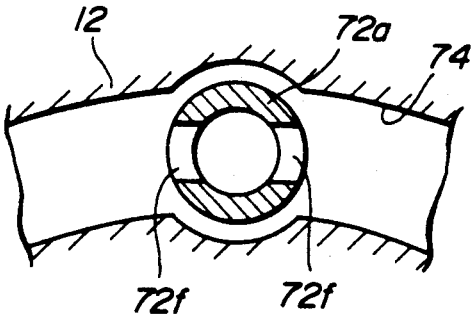
FIG. 20 is a cross sectional view of a delivery valve employed in the radial piston pump of FIG. 19.
Figure 21:
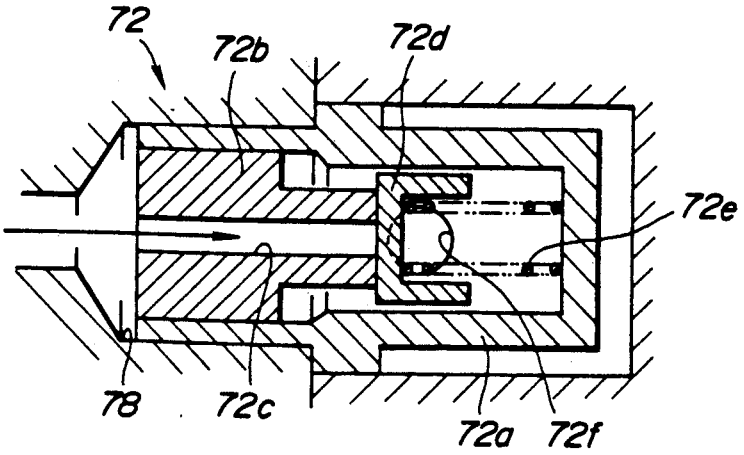
FIG. 21 is a longitudinal sectional view of the delivery valve of FIG. 20.

Referring to FIGS. 19 to 21, in which parts and portions like and corresponding to those of the previous embodiment of FIGS. 1-13 are designated by the same reference characters, a radial piston pump 10" according to a further embodiment of the present invention includes a plurality of delivery valves 72 provided to each pump sections P1-P6 and a circular discharge passage 74 formed in the casing 12 in such a way as to extend around the drive shaft 12. The discharge from the pump sections P1-P6 is collected in the circular discharge passage 74 and then conducted thereform to an outlet port 76.

The delivery valve 72, as shown in detail in FIG. 21, includes a tubular casing **72*a* having a closed end and an open end and press-fitted in a valve hole 78 formed in the casing 12, a valve seat 72*b* fitted in the valve casing 72*a* adjacent its open end and having a fluid passage 72*c* extending therethrough and a valve body 72*d* disposed within the valve casing 72*a* and urged by a spring 72*e* to seat on the valve seat 72*b* for thereby closing the fluid passage 72*c*. The valve casing 72*a* is formed with two discharge ports 72*f* which axially extend in the direction along which the fluid flows in the passage 74, i.e., in the circumferential direction of the passage 74**.

In order that the discharge ports **72*f* are arranged in place in the circular discharge passage 74, the following locating techniques are employed upon press fitting of the valve casing 72*a* into the valve hole 78**.

Figure 22:
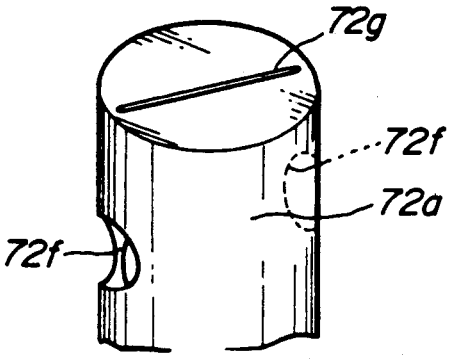
FIGS. 22 to 24 are views showing how to locate the delivery valve of FIG. 20 in installation.

(1) As shown in FIG. 22, the closed end of the valve casing **72*a* is formed with a straight line mark 72*g* indicating that the discharge ports 72*f* are located along the mark 72*g***.

Figure 23:
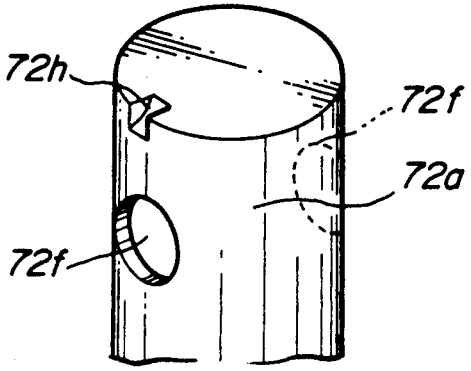

(2) As shown in FIG. 23, the valve casing **72*a* is formed with a cut mark 72*h* at the circular edge of the closed end, indicating that one discharge ports 72*f* is located below the cut mark 72*h***.

Figure 24:
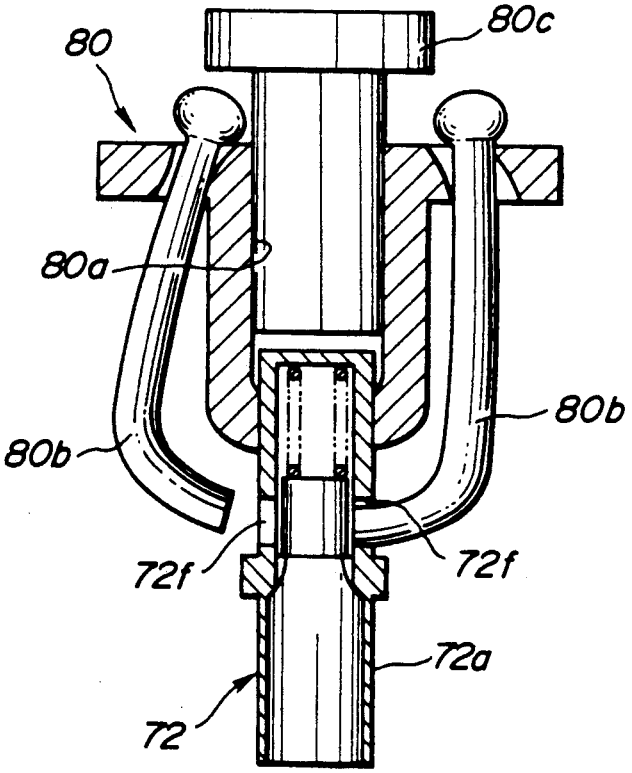

(3) As shown in FIG. 24, a jig 80 is used which consists of a guide cylinder **80*a*, a pair of location fingers 80*b* and a punch 88*c*. The valve casing 72*a* is pressed into the valve hole 78 by being pushed with the punch 80*c* which slides in the guide cylinder 80*a***.

In operation, when the discharge fluid from each pump sections P1-P6 becomes of such a pressure that exceeds a delivery valve opening pressure which is determined by the spring **72*e* of the delivery valve 72, it is discharged into the circular discharge passage 74 through the outlet ports 72*f* and then into the outlet port 76**.

At the time of discharge of the pressurized fluid from the delivery valve 72, the pressurized fluid can flow smoothly into the circular discharge passage 74 without violently striking against the circumferential walls of the circular discharge passage 74 and being subjected to any flow restriction since the delivery valve 72 is provided with only the outlet ports **72*f* that are so formed as to extend circumferentially of the passage 74**. The violent striking of the pressurized fluid against the walls of the fluid passages will cause errosion. Thus, by the above arrangement, it becomes possible to prevent the errosion, surge pressure, accelerated wear of the piston and eccentric cam due to the surge pressure, and an insufficient flow rate of fluid due to restricted fluid flow otherwise occuring in the prior delivery valve.

Figure 25:
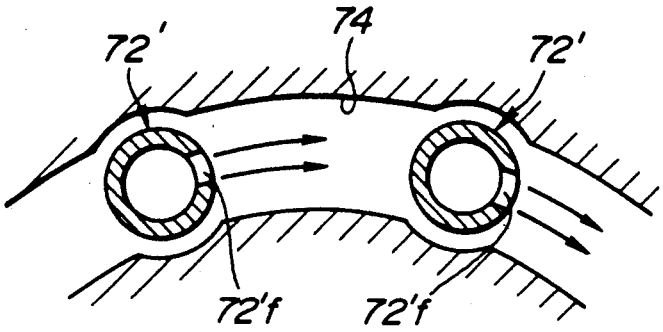
FIG. 25 is a sectional view of a variant of a delivery valve for the radial piston pump of FIG. 20.

FIG. 25 shows a variant in which each delivery valve 72' is formed with a single discharge port **72'*f* and arranged so that the discharge ports 72'*f* of the adjacent two delivery valves 72' are arranged on the same side, i.e., the discharge port 72'*f* of one of adajcent two delivery valves 72' is located on one side and the discharge port 72'*f* of the other of the adjacent two delivery valves 72' is located on the side diametrically opposite to the side facing to the discharge port 72'*f* of the above one delivery valve 72'**.

Figure 26:
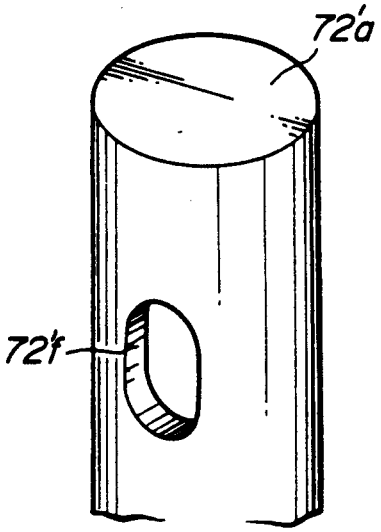
FIG. 26 is a fragmentary perspective view of another variant of a delivery valve for the radial piston pump of FIG. 20.

FIG. 26 shows a variant in which the valve casing **72'*a* is axially extended so that the discharge port 72'*f*** is formed into an elongated hole or an oval-shaped hole of a larger opening area.

Figure 27:
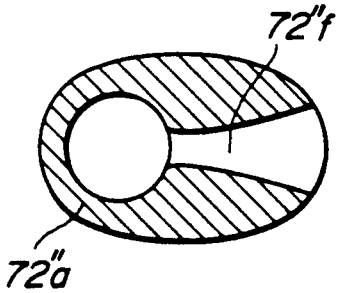
FIG. 27 is a sectional view of a further varient of a delivery valve for the radial piston pump of FIG. 20.

FIG. 27 shows a further variant in which the valve casing **72"*a* is made thicker in part of a circumferentail wall and thereby formed so as to have an oval-like cross section. The discharge port 72"*f*** is formed in the thicker circumferential wall portion in such a way as to have a diffuser-like passage.

By the variants of FIGS. 25 to 27, the discharge flow from each delivery valves can be prevented from interfering with each other more efficiently and therefore can be more smoothly conveyed through the circular discharge passage.

While a single circular groove is shown in the above, another circular groove may be provided so that one circular discharge passage is communicated with a first group of pump sections and the other circular dischage passage is communicated with a second group of pump sections in the case of the variable displacement radial piston pumps of the previous embodiments.

What is claimed is:

1. A variable displacement radial piston pum comprising:

a drive shaft;

an eccentric cam means eccentrically arranged on said drive shaft and rotatable therewith;

a casing formed with a plurality of cylinders spaced and radially arranged around said drive shaft;

a plurality of pistons respectively installed in said cylinders and having inner ends in contact with said eccentric cam means;

said cylinders and said pistons cooperating with each other to define a plurality of pump sections which are grouped into two;

suction passage means for conducting fluid into said pump sections and said shaft is rotated, said eccentric means causing said pistons to reciprocate;

first discharge passage means communicating with a first group of said pump sections for conducting discharge from said first group of said pump sections as said pistons reciprocate;

second discharge passage means communciating with a second group of said pump sections for conducting discharge from said second group of said pump sections as said pistons reciprocate;

third discharge passage means communicable with said first and second discharge passage means for collecting discharge therefrom; and control valve means for selectively and combindedly supplying fluid from said first and second discharge passage means to said third discharge passage means and thereby stepwisely varying discharge through said third discharge passage means.

2. A variable displacement radial piston pump according to claim 1 wherein said pump sections are arranged in a circular array with equal intervals.

3. A variable displacement radial piston pump according to claim 2 wherein said first and second groups include the same number of said pump sections, each pump section of said first group being operative to effect larger discharge than each pump section of said second group for a given r.p.m. of said drive shaft.

4. A variable displacement radial piston pump according to claim 3 wherein said eccentric cam means has a uniform eccentricity, said pistons of said first group being larger in diameter than said pistons of said second group.

5. A variable displacemnt radial piston pump according to claim 3 wherein said eccentric cam means has a uniform eccentricity, each pistons of said first and second pump sections being formed with suction ports which are covered and uncovered by said cylinders during reciprocation of said pistons, the distance between said inner end of each piston and said suction port of said first group of said pump sections being larger than that of said second group of said pump sections.

6. A variable displacement radial piston pump according to claim 2 wherein said first group includes the larger number of pump sections than said second group.

7. A variable displacement radial piston pump according to claim 1 wherein said first and second groups of said pump sections are respectively arranged in first and second circular arrays with equal intervals.

8. A variable displacement radial piston pump according to claim 7 wherein said first and second groups include the same number of said pump sections, said eccentric cam means having a uniform eccentricity, said pistons of said first group of said pump sections being larger in diameter than said pistons of said second group of said pump sections.

9. A variable displacement radial piston pump according to claim 7 wherein said first and second groups include the same number of said pump sections, said eccentric cam means having a uniform eccentricity, each pistons of said first and second pump sections being formed with suction ports which are covered and uncovered by said cylinders during reciprocation of said pistons, the distance between said inner end of each piston and said suction port of said first group of said pump sections being larger than that of said second group of said pump sections.

10. A variable displacement radial piston pump according to claim 7 wherein said eccentric cam means comprises a first eccentric cam of a larger eccentricity and a second eccentric cam of a smaller eccentricity, said first and second groups of said cam sections being in contact with said first and second cams, respectively.

11. A variable displacement radial piston pump according to claim 7 wherein said eccentric cam means has a uniform eccentricity, said first group including a larger number of said cam sections than said second group.

12. A variable displacement radial piston pump according to claim 7 wherein said first and second groups of said pump sections are arranged so as to overlap axially of said drive shaft.

13. A variable displacemnt radial piston pump according to claim 1, further comprising drain passage means, said control valve means comprising a three position directional control valve disposed in said first and second discharge passage means and having a first position where it fluidly connects said second discharge passage means to said third discharge passage means and said first discharge passage means to said drain passage means, a second position where it fluidly connects said first discharge passage means to said third discharge passage means and said second discharge passage means to said drain passage means, and a third position where it fluidly connects both said first and second passage means to said third passage means.

14. A variable displacement radial piston pump according to claim 13, further comprising two check valves respectively disposed in said first and second discharge passage means at locations between said control valve and respective one of said first and second group of said pump sections, and an accumulator in communication with said third discharge passage means.

15. A variable displacement radial piston pump accordcing to claim 1, further comprising first drain passage means communicating with said first discharge passage means, second drain passage means communicating with said second discharge passage and third drain passage means communicating with a reservoir, said control valve means being disposed between said third passage means and said first and second drain passage means for selectively connecting said first and second drain passage means to said third passage means and thereby controlling supply of fluid from said first and second discharge passage means to said third discharge passage means.

16. A variable displacement radial piston pump according to claim 15, further comprising two check valves disposed in said first and second discharge passage means, respectively, said first and second drain passage means being joined with said first and second discharge passage means at the locations upstream of said check valves.

17. A variable displacement radial piston pump according to claim 16 wherein said control valve means comprises a three position directional control valve having a first position where it fluidly connects said first drain passage means to said third drain passage means and obstructs communication between said second and third drain passage means, a second position where it fluidly connects said second drain passage means to said third drain passage means and obstructs communication between said first and third drain passage means, and a third position where it obstructs both said first and second drain passage means and said third drain passage means.

18. A variable displacement radial piston pump according to claim 17, further comprising an accumulator in communication with said third discharge passage means.

19. A variable displacement radial piston pump according to claim 16 wherein said control valve means comprises a pair of first and second two position directional control valves, said first two position directional control valve having a first position where it fluidly connects said second drain passage to said second two position directional control valve and obstructs communication between said first drain passage means and said second two position directional control valve and a second position where it fluidly connects said first drain passage means to said second two position directional control valve, said second two position directional control valves having a first position where it fluidly connects said first two position directional control valve to said third drain passage means and a second position where it obstructs communication between said first two position directional control valve and said third drain passage means.

20. A radial piston pump comprising:

a drive shaft;

an eccentric cam means eccentrically arranged with said drive shaft and rotatable therewith;

a casing formed with a plurality of cylinders arranged radially in a circular array around said drive shaft;

a plurality of pistons respectively installed in said cylinders and having inner ends in contact with said eccentric cam means;

said cylinders and said pistons cooperating with each other to define a plurality of pump sections;

suction passage means for conducting fluid into said pump sections as said shaft is rotated, said eccentric cam means reciprocating said piston;

discharge passage means communicating with said pump sections for conducting discharge from same as said pistons reciprocate;

each of said pump sections including delivery valves through which fluid is discharged from said pump sections;

said discharge passage means including a circular discharge passage in which fluid discharged through said delivery valves is collected, each delivery valve having a valve casing disposed in said circular discharge passage and formed with a discharge post, the axis of which is extended circumferentially of said circular discharge passage.

21. A radial piston pump according to claim 20 wherein said discharge port is arranged so as to face a side of a valve casing of adjacent one delivery valve, which side is diameterially opposed to a side where said adjacent one delivery valve is formed with a discharge port.

22. A radial piston pump according to claim 20 wherein said valve casing is formed at an end with a line mark for indicating the location of said discharge port.

23. A radial piston pump according to claim 20 where said valve casing is formed at a peripheral edge with a cut for indicating the location of said discharge port.

24. A radial piston pump according to claim 20 wherein said discharge port is elongated axially of said valve casing.

25. A radial piston pump according to claim 20 wherein said valve casing is made thicker in part of a circumferential wall and thereby formed so as to have an oval-like cross section, said discharge port being formed in said thicker circumferential wall portion in such a way as to provide a diffuser-like passage.

* * * * *